United States Patent [19]

Miller

[11] Patent Number: 4,654,905

[45] Date of Patent: Apr. 7, 1987

[54] BODY SUPPORT FOR BED OR SEAT

[75] Inventor: John E. Miller, Denton, N.C.

[73] Assignee: Parma Corporation, Denton, N.C.

[21] Appl. No.: 680,189

[22] Filed: Dec. 10, 1984

Related U.S. Application Data

[63] Continuation-in-part of Ser. No. 559,235, Dec. 8, 1983, Pat. No. 4,620,336, which is a continuation-in-part of Ser. No. 367,874, Apr. 13, 1982, Pat. No. 4,489,450.

[51] Int. Cl.[4] ..... A47L 23/02

[52] U.S. Cl. ..... 5/249; 5/250; 5/267

[58] Field of Search ..... 5/247, 249, 250, 255, 5/267, 274, 312

[56] References Cited

U.S. PATENT DOCUMENTS

| | | | |
|---|---|---|---|
| 149,758 | 4/1874 | Junge . | |
| 332,081 | 12/1885 | Jefferey . | |
| 341,246 | 5/1886 | Keenholts | 5/250 |
| 399,867 | 3/1889 | Gail et al. . | |
| 497,156 | 5/1893 | Young | 5/312 |
| 514,898 | 2/1894 | Beall | 5/255 |
| 516,195 | 3/1894 | Gail | 5/250 |
| 757,420 | 4/1904 | Smith | 5/274 |
| 902,011 | 10/1906 | Staples | 5/267 |
| 927,982 | 7/1909 | Klipfel . | |
| 1,285,721 | 11/1918 | Johnston | 5/250 |
| 1,920,176 | 8/1933 | Atwood | 5/274 |
| 2,239,877 | 4/1941 | Ciullo | 5/308 |
| 2,560,842 | 7/1951 | Blumenstaadt et al. | 5/255 |
| 2,634,427 | 4/1953 | Wodarsky . | |
| 2,773,270 | 12/1956 | Roselle . | |
| 2,874,390 | 2/1959 | Stone . | |
| 3,085,259 | 4/1963 | Sandor . | |
| 4,377,279 | 3/1983 | Schulz | 5/250 |
| 4,475,724 | 10/1984 | Hancock | 5/255 |

*Primary Examiner*—Gary L. Smith
*Assistant Examiner*—Michael F. Trettel
*Attorney, Agent, or Firm*—William E. Mouzavires

[57] ABSTRACT

A body support such as a mattress, box spring or the like that is foldable between a use position wherein it extends in a generally horizontal plane and a storage position wherein one section overlies the other section. The body support includes a plurality of support members movable between erect and retracted positions in response to movement of the body support between the use and storage positions. One embodiment disclosed relates to a box spring and a second embodiment relates to a mattress. Also disclosed is a novel construction and arrangement of support members incorporated in the body support.

39 Claims, 17 Drawing Figures

2.
2.
7.
7.
9.
9.
10
12
12
16
18
24
24
26
32
40
54
55
60
62
64
C
D
E 10
50
52
54
55
60
64

10
16
18
26
50
60
62
64
C
D 16
18

40
42
42

BODY SUPPORT FOR BED OR SEAT

RELATED APPLICATIONS

The present application is a continuation-in-part of my pending U.S. patent application Ser. No. 559,235, now U.S. Pat. No. 4,620,336, filed Dec. 8, 1983 and entitled "Box Spring And Method of Storing Same." The latter application is a continuation-in-part of my copending U.S. patent application Ser. No. 367,874, filed Apr. 13, 1982 and entitled "Body Support For Bed Or Seat," now U.S. Pat. No. 4,489,450. The present application is also a continuation-in-part of the latter application, Serial No. 367,874. The disclosures of my aforementioned applications, Ser. Nos. 559,235 and 367,874 are hereby incorporated by reference into the present application and made a part hereof.

BACKGROUND OF INVENTION

Conventional body support such as box springs or mattresses typically include an array of coil springs for supporting the body. The upper ends of the coil springs are attached to a wire grid made from a low carbon wire of limited resilience. The perimeter of the grid is attached to a border wire. Although such coil spring arrangements have provided adequate body support, they are relatively expensive to manufacture and assemble into box springs or mattresses. Additionally, conventional box springs and mattresses are large and cumbersome to handle in storage, transporation or shipment which, of course, increases the ultimate cost.

Moreover, it is not uncommon for a coil spring manufacturer to compress or deform coil spring units layered one on top of the other into condensed or compacted multilayered packs for shipment to a box spring or mattress manufacturer. The aforementioned step is performed by means of a press machine enabling the spring units to be compressed to reduce their dimension. The coil spring units of each pack are held in their compacted state against return to their normal or unstressed condition by means of strapping applied about the unit. The spring units of each pack being compressed, the strapping is under a great amount of tension. When the packs arrive at the place of the manufacturer, it is, of course, necessary to sever the strapping around the packs in order to release the spring units for installation into box springs or mattresses. This, of course, is a dangerous step because of the high degree of tension to which the strapping is subjected by the compression of the coil springs.

As can be seen from U.S. Pat. No. 4,377,279, issued Mar. 22, 1983, one proposal has been made for providing a wire foundation unit for a box spring which unit can be shipped to the box spring manufacturer in a compact state. The manufacturer would erect the foundation wires and then fix by staples, rigid struts between the wire unit and the base to permanently secure the wire unit in the erected position. The box spring manufacturing process would then be completed by providing the conventional layer of padding on the top of the wire foundation and a sheet covering or casing about the entire unit. However, once the manufacture is completed, the box spring is no longer collapsible and thus must be shipped in its expanded or full-size state to the point of retail or use whereby the same storage and shipment costs result at this point as with conventional box springs.

OBJECTS OF THE PRESENT INVENTION

It is an object of the present invention to provide a body support for a bed, seat or like articles which will reduce the unit costs of manufacturing, handling, storage and shipment thereof. Included herein is a novel method of storing a body support such as a box spring or mattress for shipment or other purposes.

A further object of the present invention is to provide a novel body support that may be packaged, stored or transported prior to use in a depressed or collapsed state and later expanded or erected to a use position at the point of use. Included herein is a body support that once erected for use, display or otherwise, may be subsequently collapsed or depressed into a compact state for storage, handling or shipment and then again erected for use or otherwise, and wherein the conversion may be repeated as often as desired. Further included herein is such a body support that may be moved between a useful position and a storage position in which the depth and length dimensions of the body support have been substantially reduced.

Another object of the present invention is to provide a novel body support that may be folded upon itself into two overlying sections to decrease the length thereof for storage, handling or shipment. Another object is to provide a novel body support that may be folded upon itself into two overlying sections which at the same time reduces the depth dimensions of the sections. Additionally, the body support may be subsequently unfolded to restore it to its normal state for use after which it may be again folded for storage, handling or shipment, and wherein the conversion may be repeated as often as desired.

A further object of the present invention is to provide a novel construction for a body support such as a box spring, mattress or seat which construction eliminates the need to rely on conventional coil springs for support. Included herein is the provision of a novel construction and arrangement of support elements that may be utilized to construct a mattress, box spring or like articles.

A still further object is to provide a novel body support such as a mattress, box spring, seat or the like incorporating a novel support system which is less costly to manufacture than conventional coil-spring body supports and yet will provide comfortable support for the body when in use.

A still further object of the present invention is to provide such a novel body support that will achieve the above objects and yet may be commercially manufactured in various conventional bed or seat sizes or other sizes.

SUMMARY OF INVENTIONS

A body support according to one aspect of the invention includes a plurality of support members or springs movable between a retracted or collapsed position and an extended or erected position. In their retracted positions, the support members are generally unstressed and lie in generally horizontal planes. Thus, the body support is substantially reduced in its depth dimension thereby facilitating storage handling and/or shipment at reduced unit cost. In their extended positions, the support members are erect in generally vertical planes and thus, the body support is ready for use. After use, the body support may be collapsed to its storage position and then later expanded to its use position and this process may be repeated as often as desired.

In one preferred embodiment, the body support is constructed to be foldable upon itself into two overlying sections, thus reducing the length in half for storage. This action is also used to actuate the support members into their retracted positions. Unfolding of the sections to place them into a coplanar position, actuates the support members to their erect position for providing support for the body when in use.

In accordance with another aspect of the invention, a novel support spring network is provided including support members formed by spring wire bent into non-spiral, generally two-dimensional, shapes including serpentine or sinusoidal portions extending generally in the same planes. Extending lengthwise across the tops of the support members at spaced intervals are a plurality of runners formed of spring wire with offset portions movably attached to the support members.

DRAWINGS

DETAILED DESCRIPTION

Figure 1:
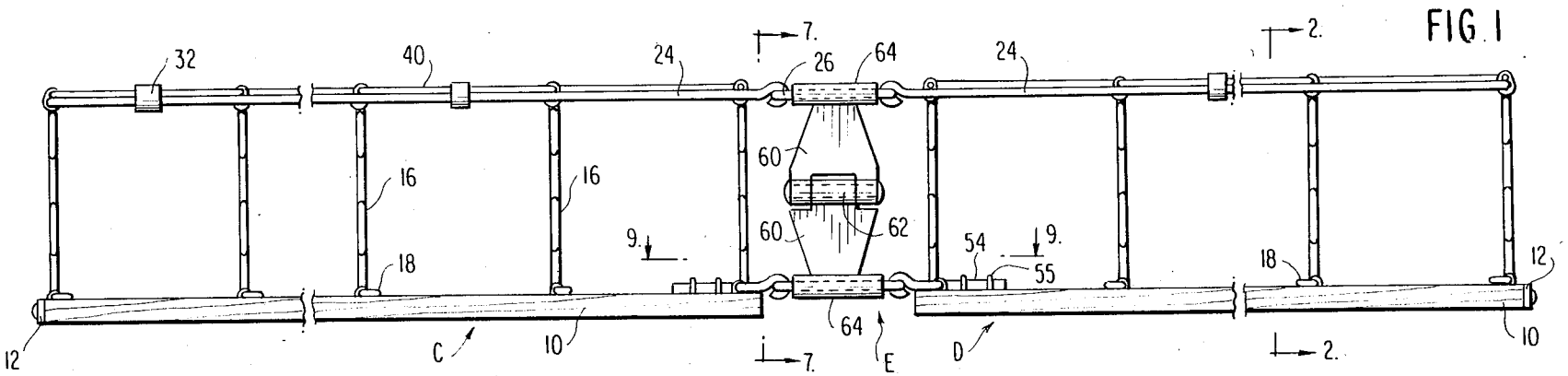
FIG. 1 is a side elevational view of a box spring constituting one embodiment of the present invention shown in a use position and with certain parts removed and others broken away for clarity.

Referring now to the drawings in detail and initially with respect to FIGS. 1 through 10, there is shown for purposes of illustration only, a box spring embodying the present invention. In FIG. 1, the box spring is shown in a use position where it extends in a generally horizontal plane, however, the covering of the box spring including a pad which is placed between the cover layer and the top of the box spring support members 16 have been removed for the sake of clarity. It will therefore be understood that any suitable cover and/or padding may be employed with the box spring without departing from the scope of the present invention.

Figures 2, 3, 4:
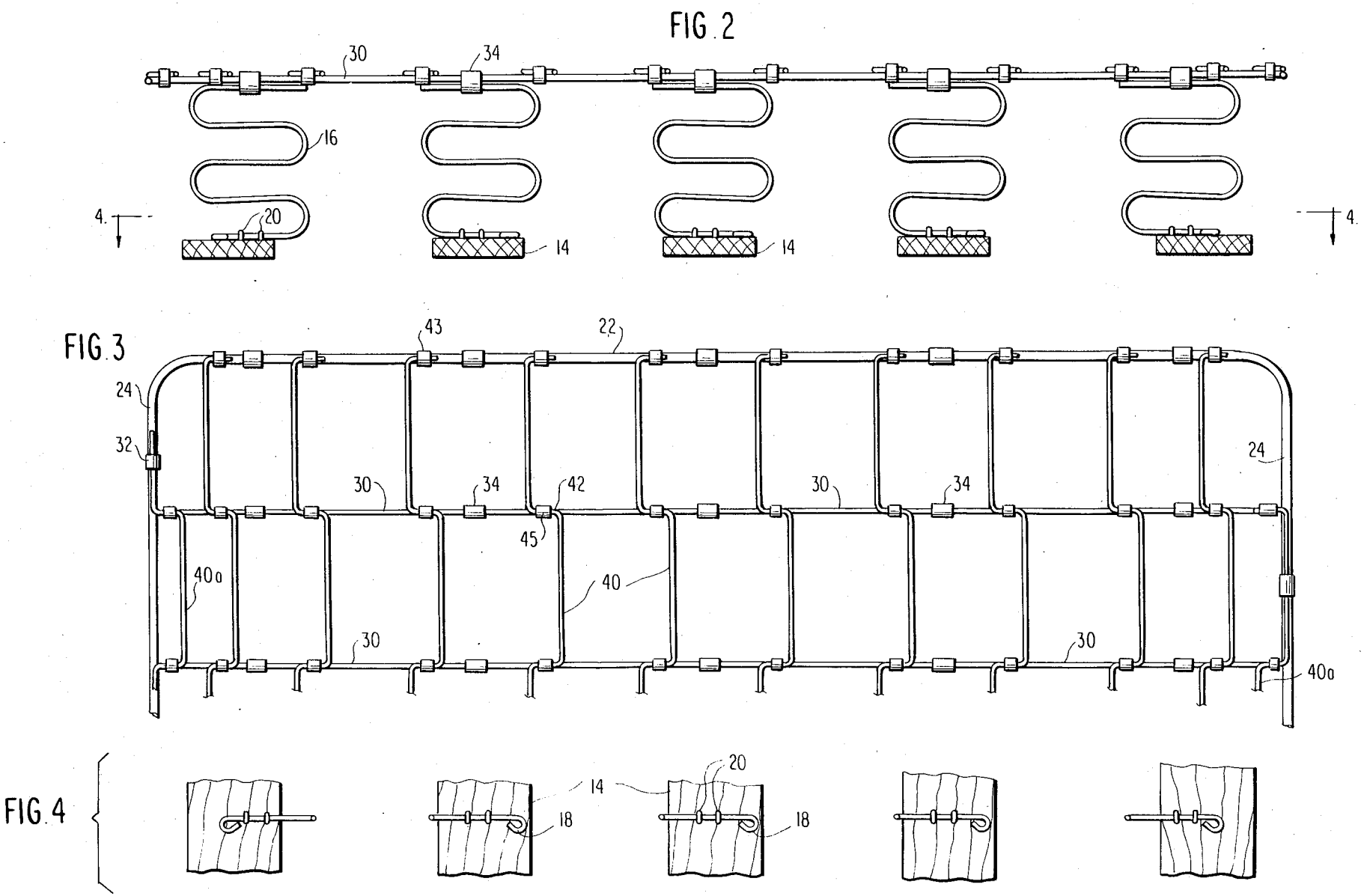
FIG. 2 is a transverse, cross-sectional view taken generally along lines 2—2 of FIG. 1.
FIG. 3 is a fragmentary plan view of the box spring shown in FIG. 1.
FIG. 4 is a cross-sectional view taken generally along lines 4—4 of FIG. 2.
Figure 7:
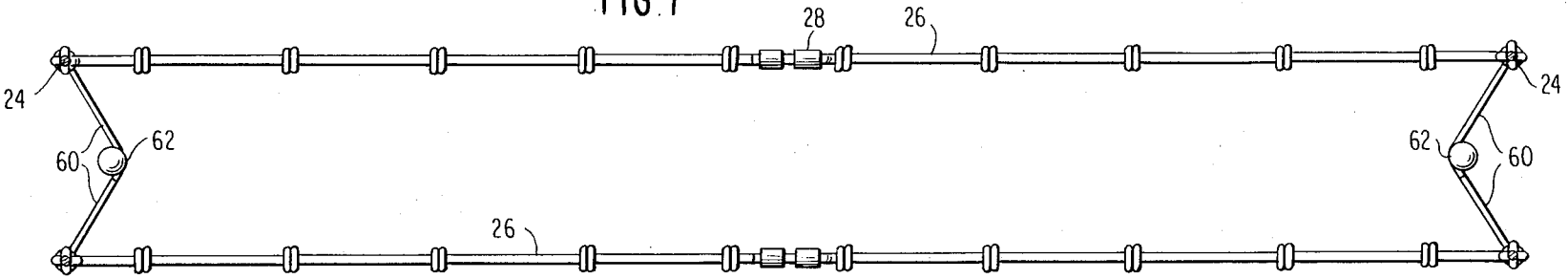
FIG. 7 is a transverse, cross-sectional view taken generally along lines 7—7 of FIG. 1.

In the specific embodiment shown, the box spring is formed in two main sections C and D interconnected by an intermediate or transition section E as shown in FIG. 1. The transition section E is also disclosed in plan view in FIG. 8. Each section C and D includes a base frame which may have any suitable construction including opposite side members 10 which may be made of wood, for example, interconnected by opposite end members 12 to form a generally rectangular configuration. Extending longitudinally within the base frame and parallel to the side members 10 are a plurality of slats 14 as best shown in FIG. 2 wherein it is seen that the slats are uniformly spaced from each other. The ends of slats 14 are suitably rigidly secured by fasteners to end members 12. Any other suitable base frame construction may be employed such as that disclosed in my copending application Ser. No. 06/559,235 identified above.

Figure 5:
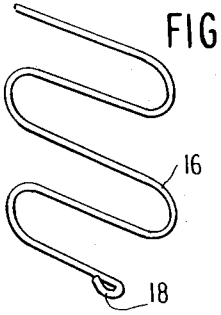
FIG. 5 is a perspective view of a plurality of support members in the form of a spring, incorporated in the box spring.

Pivotally mounted on the slats 14 are a plurality of support members generally designated 16 which are shown as springs formed from, for example, nine (9) gauge spring wire bent into a sinusoidal or serpentine configuration as best shown in FIGS. 2 and 5. With the exception of foot portions 18 on the lower run of each of the springs 16, each of the portions of the springs extend in generally the same plane as best shown in FIG. 1. Springs 16 are each pivotally mounted by any suitable means such as the staples 20 shown, to the slats 14 in the base frames for movement between a retracted position partially shown in FIG. 10 and an erect position shown in FIGS. 1 and 2. In their fully retracted position illustrated in the lower section C of FIG. 10, springs 16 extend generally in a horizontal plane adjacent the base frame 10 and are generally unstressed in this position. As shown in FIGS. 1 and 2, springs 16 are provided in a plurality of parallel rows extending across the frame throughout the length of the frame. The number and spacing of the springs and the rows of springs are selected to provide a desired support for the body. That is to say, that soft, medium or firm support may be provided depending on the number and spacing of the springs and the construction of the springs themselves. When viewing the body support in the longitudinal direction as seen in FIG. 2, springs 16 in the specific embodiment are placed one behind the other in alignment with uniform spacing therebetween as best shown in FIG. 3. When viewed in the transverse direction of the body support as shown in FIG. 1, the rows of springs are uniformly spaced from each other and it will further be seen that in their erect positions, springs 16 in each row extend in generally the same plane as best illustrated in FIG. 1.

Figure 8:
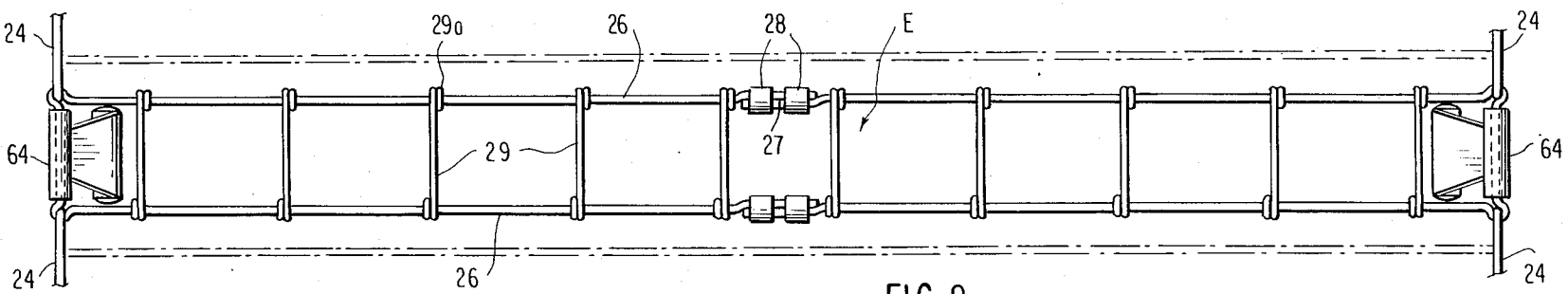
FIG. 8 is a fragmental plan view of the structure shown in FIG. 7.

The upper runs of the springs 16 are pivotally attached to a top frame which includes a border wire including an end portion 22, opposite side portions 24 shown in FIG. 3, and inner end portions 26 shown in FIG. 8. In the specific embodiment, each of the end and side portions 22 and 24 of the border wires are made from the same piece of wire while the inner end portions 26 of the border wires are made from a separate wire piece which is formed into a rectangular configuration as shown in FIG. 8 with its opposite ends hooked around side portions 24. The end extremities 27 of the inner end portions 26 of the border wire are fastened together by suitable clips 28 as best shown in FIG. 8.

Referring to FIG. 3, a plurality of wires 30 extend between the opposite side portions 24 of the border wire and are fastened thereto by suitable clips 32. Wires 30 are located across the frame throughout the length of the border wires at locations corresponding to the upper runs of the support springs 16. Wires 30 are formed from spring wire of fifteen (15) gauge, for example. As shown in FIGS. 2 and 3, the upper runs of support springs 16 are pivotally connected to cross wires 30 by suitable means such as the clips 34 shown in FIG. 3. The attachment through clips 34 is such as to permit the springs to pivot relative to the wires 30 into or out of their erect and retracted positions.

Figure 6:
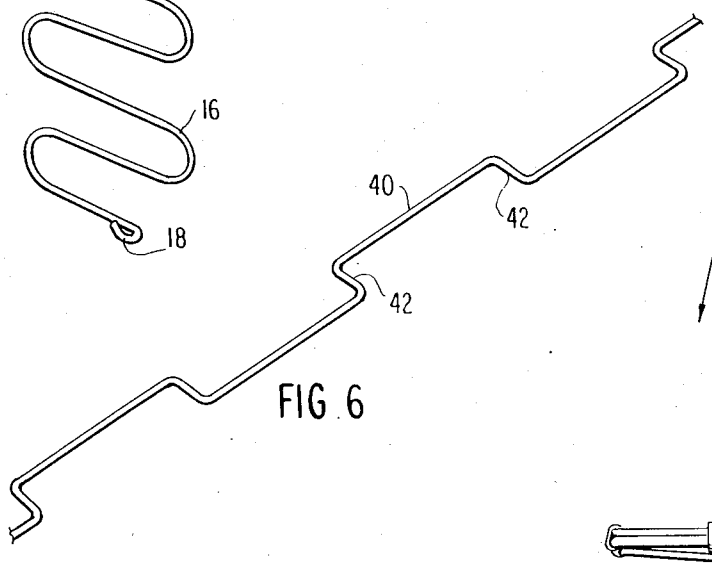
FIG. 6 is a perspective view with portions broken away of one of a plurality of runners incorporated in the box spring.

Extending longitudinally throughout the upper frame between the outer and inner ends 22, 26 of the border wires are a plurality of runners made from spring wire, for example, of fifteen (15) gauge. The runner wires are shown at 40 in FIG. 3 and include a plurality of offset portions 42 as also seen in FIG. 6. The opposite ends of runner wires 40 are attached by suitable clips 43 to the outer and inner end portions 22 and 26 of the border wire. As shown in FIG. 3, the intermediate offset portions 42 of the runner wires 40 are attached by clips 45 to the transverse extending cross wires 30. In the specific embodiment, the clips 32 which attach the cross wires 30 to the border wires are also employed to attach the endmost runner wires 40*a* to the sides of the border wire as shown in FIG. 3. The attachment of the runner wires 40 to the border wires and to the cross wires 30 through means of the clips is made to allow a certain degree of movement of the runner wires 40 relative to the border wires and the cross wires 30. It will thus be seen that the top frame includes the border wires 22, 24, 26, the cross wires 30 attached at their opposite ends to the side border wire portions 24, and the longitudinally extending runners 40 attached at their opposite ends to the end border wire portions 22, 26 and attached at their offset intermediate portions 42 to the cross wires 30. This construction utilizing spring wire increases the resilience of the upper support surfaces while, at the same time, allowing the runner portions 40 to resiliently deflect in torsion about axes extending through their offset portions 42 when a load is placed thereon so that deflections at a loaded area of the support network will not be reflected throughout adjacent and other areas of the support network which, of course, enhances comfort when using the body support.

Figure 9:
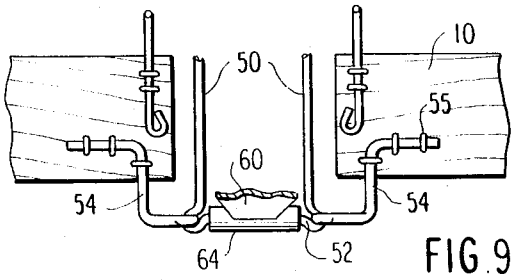
FIG. 9 is a fragmentary, cross-sectional view taken generally along lines 9—9 of FIG. 1.

Referring now to FIG. 9, there is provided a pair of wires 50 which are aligned below the inner border wire portions 26 when the body support is in the use position shown in FIG. 1. In the specific embodiment shown, wires 50 are made from the same piece of wire similar to border wire 26 described above and includes opposite end portions 52 which are connected to the opposite side frame portions 10 of the base frame by means of wire straps 54. The latter are hooked at one end over wire portions 52 and at the opposite end are fixed, such as through staples 55, to the base frame portion 10 as shown in FIGS. 1 and 9. It will be seen that wires 26 and 50 in effect provide pivots for swinging the frame sections C and D relative to each other and the transition section E between the horizontal use position shown in FIG. 1 and the folded position partially shown in FIG. 10. That is to say, that the sections C and D of the body support are pivotable or swingable relative to the transition section about transverse axes extending through the wires 26 and 50. During such action, support springs 16 are, of course, pivotable relative to the base frame 10 and the upper frame as best illustrated in FIG. 10.

In the specific embodiment shown, the erect position of the springs 16 and the body support as shown in FIG. 1 is determined by an abutment means which, in the specific form illustrated, includes a plurality of stops formed by the feet 18 on the lower runs of each of the support springs 16 as best shown in FIGS. 1 and 5. Stops 18, in the specific embodiment, are formed by bending an extremity portion of the lower run of the springs 16 to project at about 90° degrees laterally from the main plane of the springs 16 so that when the springs 16 are pivoted into a plane extending approximately 90 degrees to the base frame, stops 18 will engage against the slats 14 of the base frame to prevent pivoting of the springs 16 beyond their 90° degree erect position. When the springs 16 are retracted upon folding of the sections C and D into the retracted positions illustrated in FIG. 10, for example, stops 18 will, of course, move out of engagement with the slats 14 of the base frame. Note that the springs 16 in section C are oriented with their stops 18 projecting to the right (as viewed in FIG. 1) and the springs 16 in Section D are oriented with their stops projecting to the left. This is so because in pivoting between their retracted and erect positions, springs 16 pivot in opposite directions.

Figure 10:
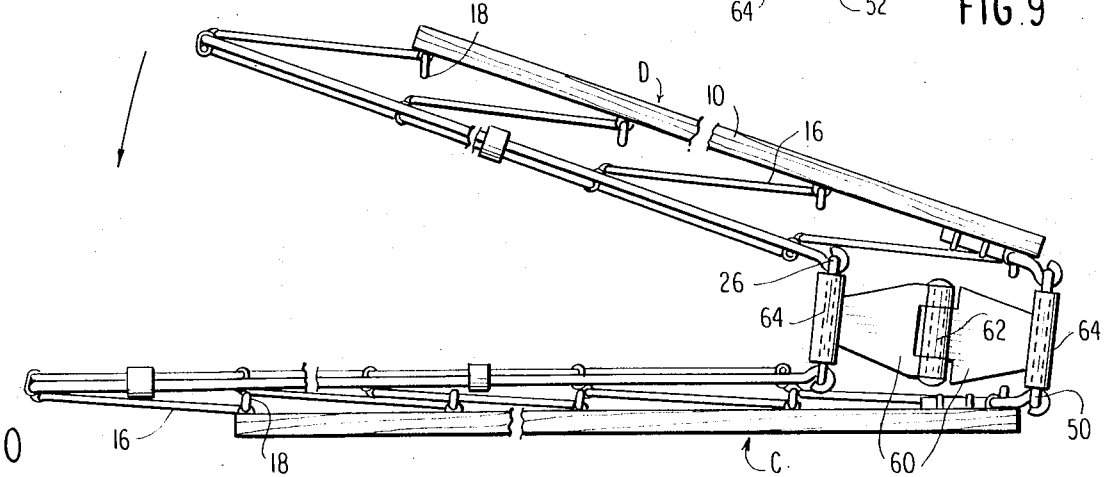
FIG. 10 is a view generally similar to FIG. 1 except showing the box spring in partially folded position.

In order to maintain the pivot wires 26 and 50 in the same position relative to each other to provide the desired pivotal movement of the sections C and D relative to the transition section E as shown in FIG. 10, means is provided in the form of a yieldable brace or constraining means for holding wires 26 and 50 at a predetermined position relative to each other. In the specific embodiment shown, the constraining means includes upper and lower rigid leaves 60 pivoted to each other by the pivot 62 with the outer ends of the leaves having barrels 64 receiving end portions of the wires 26 and 50 as best shown in FIGS. 1 and 10. Barrels 64 are engageable with the wire portions on the opposite ends thereof to hold the barrels in the proper position. The barrels 64 and leaves 60 will maintain the pivot axes passing through wires 26 and 50 in the desired rectangular relationship relative to each other so that sections C and D will pivot relative to the transition section E as illustrated in FIG. 10 while leaving a space between sections D and E. In addition, the constraining means will prevent the support members 16 from moving out of their erect positions as long as the sections C, D and E are in the coplanar horizontal position for use as shown in FIG. 1. Instead of the specific constraining means just described, other structures may be employed as will be seen in the embodiment to be described below. It will be understood that a constraining means is provided at the opposite ends of the transition section E as shown in FIG. 8. The transition section E also includes a plurality of straight wires 29 of spring material extending between the pivot wires 26 in the upper frame and 50 in the lower frame as best shown in FIG. 8. Wires 29 may be attached to wires 26 and 50 by any suitable means such as coils 29*a* on the ends of wires 29 received about wires 26 and 50.

It will be seen that when the box spring is folded into the position generally shown in FIG. 10. a space will remain between the upper and lower sections and this space is utilized to accommodate a pad and other bedding or covering which may be employed on the box spring. Folding and unfolding of the box spring may be accomplished manually without any special tools, and the spring members 16 will be erected and retracted automatically merely upon unfolding or folding the box spring sections. Additionally, the improved upper frame of the box spring provides enhanced resilient support that will increase comfort due to the spring wire materials and the offset portions of the wires 40.

Figure 11:
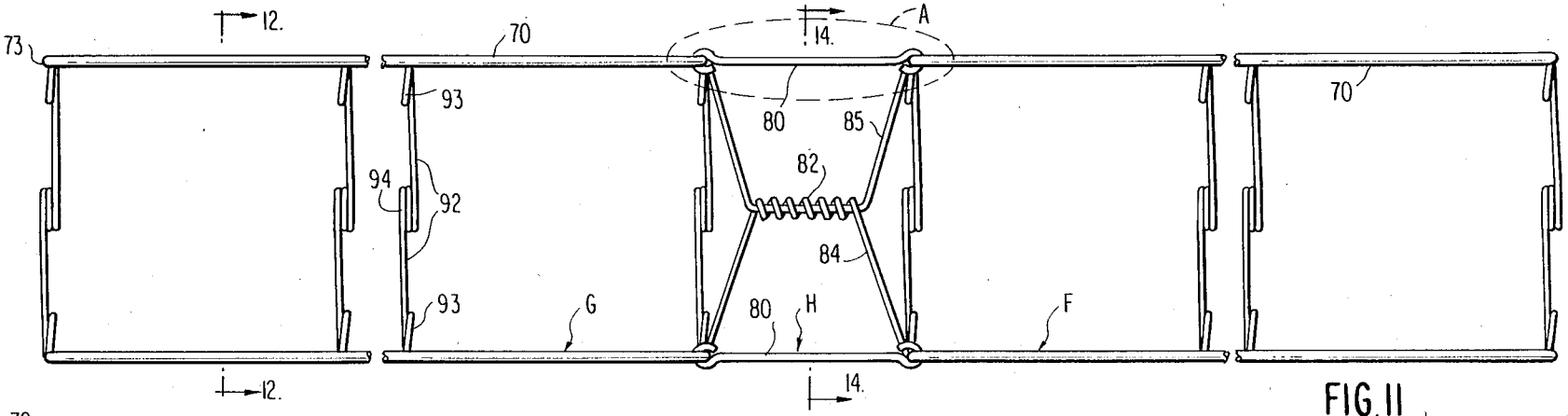
FIG. 11 is a side, elevational view of a mattress constituting a second embodiment of the invention shown in the use position and with certain portions removed and others broken away for clarity.
Figure 14:
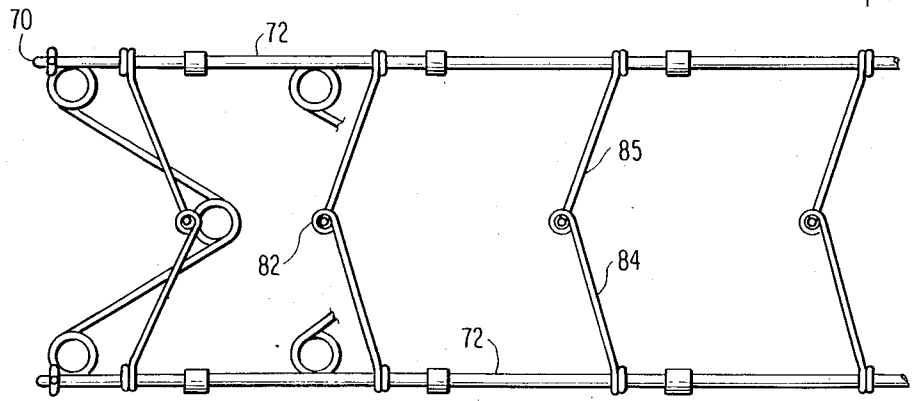
FIG. 14 is a transverse cross-sectional view taken generally along lines 14—14 of FIG. 11.
Figure 15:
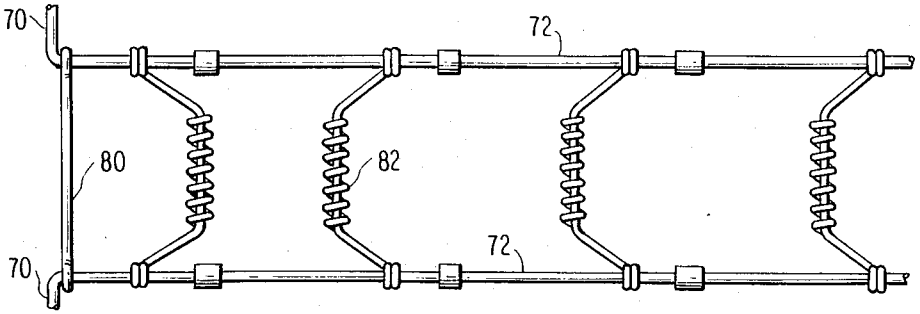
FIG. 15 is a plan view of the structure shown in FIG. 14.
Figure 12:
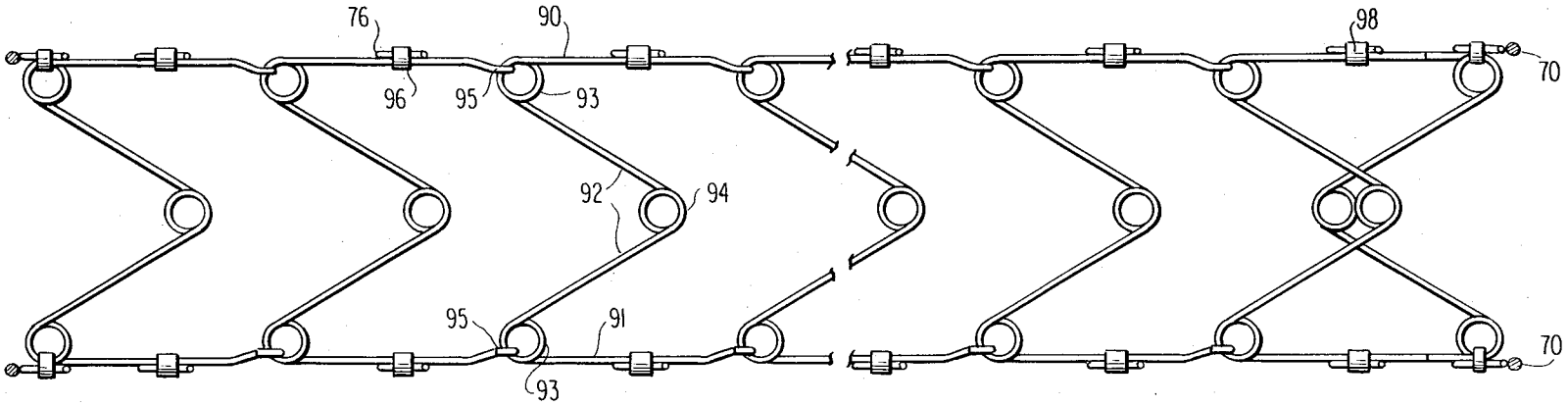
FIG. 12 is a transverse, cross-sectional view taken generally along lines 12—12 of FIG. 11.
Figure 13:
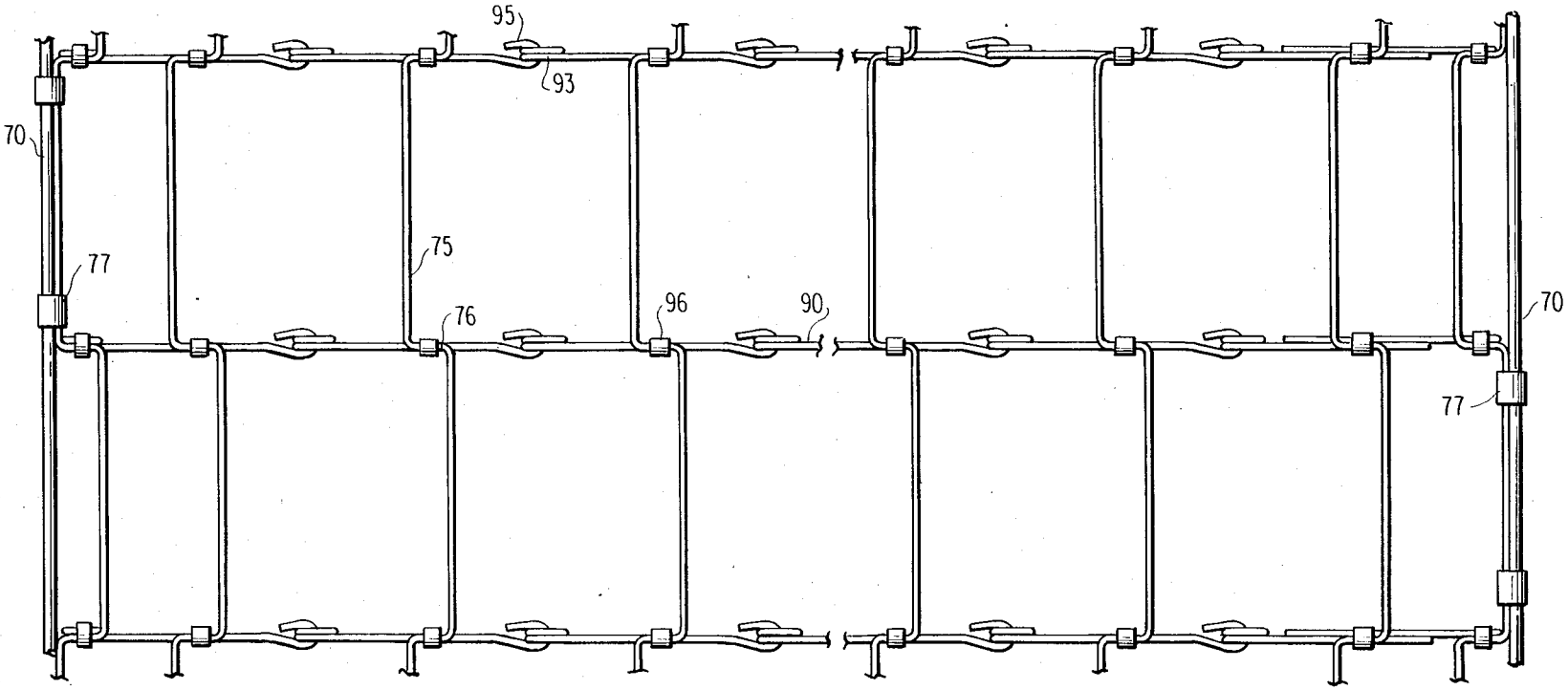
FIG. 13 is a fragmental, plan view of the mattress.

Referring now to FIGS. 11 through 15, there is illustrated another embodiment of the present invention in the form of a mattress which basically includes two sections generally designated F and G interconnected by an intermediate or transition section H as shown in FIG. 11. Sections G and F each include upper and lower generally rectangular frames each of which is formed by a rectangular border wire and runner wires extending longitudinally thereof. The border wire of each section may be made from one piece and includes opposite side portions 70, inner end portions 72 as best shown in FIG. 15 and outer end portions not shown. Extending between the opposite end portions of the border wire and movably attached thereto by clips are a plurality of runners 75 (see FIG. 13) having a plurality of laterally extending offset portions 76 similar to the runners 40 of the embodiment described above. The outermost positioned runners 75 are also attached to the side portions 70 of the border wires by clips 77 as best shown in FIG. 13. The upper and lower frames are formed by identical border wire arrangements with their inner end portions 72 serving to form pivots for folding the sections G and F relative to each other and transition section H.

Referring to FIGS. 11, 14 and 15, sections G and F are interconnected by the transition section H through means including straight wire connecting links 80 interconnecting the side portions 70 of the border wires of sections G and F; and a plurality of flexible and resilient constraining means formed of spring wire and generally designated 82 in FIG. 15. In the specific embodiment shown, the latter each include a lower generally inverted U-shaped part 84 having opposite legs coiled about adjacent inner border wire portions 72 of the lower frames and an upper generally U-shaped part 85 having opposite legs coiled about adjacent inner border wire portions 72 of the upper frames. The lower part 84 is formed with coils at its mid-section received about the mid-section of the upper part 85 as best shown in FIG. 11. As shown in FIGS. 14 and 15, a plurality of the constraining means are employed throughout the transition section H across the mattress at uniformly spaced locations. The constraining means function to keep the pivot axes defined by the inner border wire portions 72 in the proper rectangular interrelationship with each other as shown in FIG. 11 to permit the sections F and G to be pivotable relative to the transition section H between the use and storage positions. The use position is shown in FIG. 11 wherein sections G, F and H extend in horizontal coplanar relationship. In the storage position, one section G or F is folded over the other section with the transition section H extending generally at right angles to the sections G and F similar to the arrangement shown in FIG. 10.

Referring to FIGS. 11 and 12, the support members in the present embodiment include a plurality of interconnected springs each of which includes an upper generally rectilinear run 90, a lower generally rectilinear run 91, and generally V-shaped intermediate run 92 with all of the aforementioned portions lying generally in the same plane. The upper and lower runs 90 and 91 are united to the intermediate runs 92 through means of coil portions 93 while the intermediate runs 92 converge at a coil portion 94. In the preferred embodiment, each of the wire portions including the coils are formed integral with each other from the same piece of spring wire.

As shown in FIGS. 12 and 13, the extremities of the upper and lower runs 90, 91, are formed with hook portions 95 through which the springs in each row are interconnected by placing the hook portions 95 in and about the coil portions 93 of the adjacent spring. The hook portions 95 in the specific embodiment are offset inwardly from the runs 90, 91 to permit their receipt in coils 93. It will thus be seen when the springs in each row are assembled, the upper rectilinear runs 90 will extend in generally a straight line across the mattress and the lower rectilinear runs 91 will extend in a generally straight line located below and in generally the same plane as the upper runs 90. Additionally, the intermediate coils 94 will be in general horizontal alignment.

When the mattress is folded into the storage position, that is, with one section G or F located over the other section, the support springs will pivot from their erect position shown in FIG. 11 to a retracted position (not shown) similar to that of the support members 16 of the above-described embodiment. To this end, the upper and lower runs 90, 91 of the springs are pivotally attached to the longitudinally extending runners 75 at the offset portions 76 by means of suitable clips 96 so that when pivoting between their erect and retracted positions, the springs will pivot relative to the upper and lower runners 75 and, of course, the upper and lower border wires 70, 72 which, together with the runners 75, form the upper and lower frames of the mattress. When the mattress is unfolded from its storage position to the use position shown in FIG. 11, the springs will, of course, pivot upwardly into their erect positions shown in FIG. 11. The erect position of the springs is determined by the constraining means 84, 85 described above which prevents the springs from pivoting beyond their 90 degree erect position when the mattress is unfolded. Additionally, once the mattress is in the use position of FIG. 11, the constraining means 84, 85 will prevent the springs from pivoting out of their erect positions as long as the mattress sections G, F and H are in the coplanar horizontal position shown in FIG. 11.

Upon deflection of the springs when a load is placed on the mattress in the use position, the intermediate portions 92 of the springs will remain generally in the same plane as the upper and lower runs 90, 91 of the springs and will not deflect laterally to either side even though deflection of the springs will occur about the axes passing through coils 94 of the intermediate portions 92 of the springs. It will also be noted that due to the upper and lower rectilinear runs 90, 91 of the springs, cross wires such as 30 employed in the above-described embodiment, are not required in the present embodiment.

In order to provide added support at the sides of the mattress, a double spring arrangement may be provided along the sides of the mattress shown, for example, on the right-hand side of FIG. 12. In this double spring arrangement, a pair of springs are placed in opposed and partially overlapping relationship as best shown in FIG. 12 and with their free extremities clipped together by clips 98 which, in the specific embodiment, also serve to attach both springs to the runner 76 in their area. Although, not shown, this arrangement can be employed throughout the mattress if it is desired to increase the support of the mattress.

In one preferred embodiment, the runners 75 are made from fifteen (15) gauge spring wire while the support springs are made from thirteen (13) gauge spring wire. Of course, other spring configurations and gauges may be employed in keeping with the present invention. The use of the runners 75 and the support springs of the present invention replaces conventional grids and coil springs heretofor used in mattress construction, while providing greater resilient support at a cost believed to be significantly less than conventional spring mattress constructions.

In use of the mattress, the sections G and F may be placed into generally coplanar positions as best shown in FIG. 11 where the springs will provide a comfortable resilient support surface. If it is desired to fold the mattress for storage or handling, one section G or F may be swung about the pivotal axes passing through the inner border wire portions 72 to place it into overlying relationship with the other section. By virtue of the fact that the support springs are constrained, they will pivot relative to the upper and lower frames into retracted position. During such pivotal movement, the constraining means will function to keep the pivot axes defined by the inner border wire portions 72 in the proper rectangularly spaced relationship relative to each other to achieve the desired movement of the sections. If later it is desired to convert the mattress back to the use position, one section merely has to be unfolded into the horizontal position which will actuate the springs to their erect position shown in FIG. 11 to provide the desired resilient support in use. It should also be noted that the erect position of the support springs is maintained against unwanted or undesirable collapsing movement when the mattress sections are in the coplanar horizontal use positions by virtue of the constraining means which will prevent the springs from pivoting out of their erect positions. Although, not shown, any suitable cover and padding may be employed on or about the mattress frames and springs; it being understood that such elements having been excluded from the drawings for the sake of clarity. The space provided between the folded mattress sections C and D by the transition section E will accommodate the padding and cover of the mattress when folded.

Figure 16:
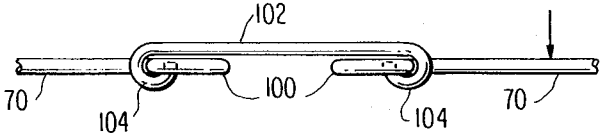
FIG. 16 is a side, elevational view of a modification of the structure shown at A in FIG. 11.
Figure 17:
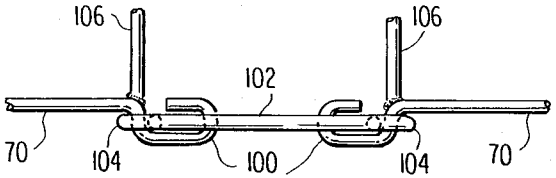
FIG. 17 is a plan view of the structure shown in FIG. 16.

Referring now to FIGS. 16 and 17, a modification of the connecting wire links between the mattress frames G and F is disclosed which may be used in substitution for the connecting wires 80 between the top frames at the location A shown in FIG. 11. In this modification, the side border wire portions 70 are formed with hooks 100 extending in horizontal planes and the connecting wires 102 are formed with hooks 104 extending in vertical planes and which are received in and about the hooks 100 of the border wire portions as shown in FIGS. 16 and 17. The inner border wires are shown at 106 in FIG. 17 and these are fastened, such as by welding or otherwise, at points 108 to the side border wire portions 70. It will be seen that if a load is placed at the arrow in FIG. 16, the load will be distributed across the connecting wire 102 without undue deflection of the connecting wire 102 due to the fact that hook portion 100 of the border wire 70 will tend to pivot upwardly into engagement with the connecting wire 102 to resist downward deflection of the connecting wire.

It will be appreciated that the modification of FIGS. 16 and 17, along with the constraining means 84, 85 used in the mattress, may also be incorporated into the box spring of FIGS. 1 through 10 described above in place of the constraining means 60, 62, 64 and the connecting link 50 described above.

What is claimed is:

1. A body support such as a mattress or a box spring including opposed upper and lower portions and a plurality of support members located between said upper and lower portions and movable between a retracted inoperative position for reducing the depth dimension of the body support measured between said opposed portions for storage or transport and an erect operative position for increasing the depth dimension of the body support for use in supporting a body, and stop means on a number of said support members for defining the erect position of said support members, said stop means being engageable with one of said upper and lower portions to define the erect position of said support members, said support members including wirelike elements, and said stop means including a bent portion integral with said wirelike elements.

2. The body support defined in claim 1 wherein said stop means includes a stop member projecting from a number of said support members.

3. The body support defined in claim 2 wherein said support members have lower ends mounted to a portion of the body support and said stop member projects from said lower ends of a number of said support members.

4. The body support defined in claim 3 wherein said bent portion is located at the lower ends of said support members.

5. The body support defined in claim 1 wherein there is further included an upper frame and a lower frame, said support members being movably connected to said upper frame, said upper and lower frames each having at least two sections and a transition section located between said two sections while being pivotally connected thereto such that one section may be folded over the other section to reduce the length of the body support, and wherein there is further included constraining means interconnecting the transition sections of the upper and lower frames to maintain said sections in predetermined position relative to each other.

6. The body support defined in claim 5 wherein said constraining means is yieldable in a generally vertical direction upon movement of said sections relative to each other.

7. A body support such as a mattress or a box spring including a plurality of support members movable between a retracted inoperative position for reducing the depth dimension of the body support for storage or transport and an erect operative position for increasing the depth dimension of the body support for use in supporting a body, and stop means on a number of said support members for defining the erect position of said support members, and wherein there is further included an upper frame, said support members being movably connected to said upper frame, said upper and lower frames each having at least two sections and a transition section located between said two sections while being pivotally connected thereto such that one section may be folded over the other section to reduce the length of the body support, and wherein there is further included constraining means interconnecting the transition sections of the upper and lower frames to maintain said sections in predetermined position relative to each other.

8. The body support defined in claim 7 wherein said constraining means is yieldable in a generally vertical direction upon movement of said sections relative to each other.

9. The body support defined in claim 7 wherein said upper frame includes a border wire at the perimeter thereof, and a plurality of runner wires formed of spring wire material extending longitundinally of the body support with their opposite ends attached to the border wire, said runners having a plurality of offset portions spaced throughout the length thereof and being connected to the support members.

10. The body support defined in claim 9 wherein said support members are springs having upper and lower runs extending generally in the same plane, and wherein said offset portions of said runners are attached to the upper runs of said springs.

11. A body support comprising a plurality of rows of wire-like support members extending across said body support at locations spaced substantially throughout the length of said body support, said support members each having upper and lower runs extending transversely of said body support and in the same general plane with the upper runs being connected to each other and the lower runs being connected to each other to form a chain of support members across said body support, an upper frame including a border wire having opposite sides, said support members being connected to said opposite sides of said border wire, said upper frame further including a plurality of wire runners extending longitudinally of said body support at locations spaced transversely of the body support and having opposite ends attached to the border wire, said runners including straight wire portions and offset intermediate portions extending at an angle to the straight wire portions and transversely of said body support, said offset portions being connected to upper runs of said support members such that the runners are deflectable in torsion about axes extending through said offset portions transversely of the body support when the body support is loaded during use.

12. The body support defined in claim 11 wherein said runners and support members are made from spring wire material.

13. The body support defined in claim 12 wherein said support members each have intermediate runs extending generally in the same plane as the upper and lower runs.

14. The body support defined in claim 11 wherein each of said upper and lower runs of a number of said support members in a row include a loop on one end and a hook on the opposite end thereof with the hook of one run being received over the loop of an adjacent run to interconnect the same, said loops and hooks being dimensioned such that adjoining hooks and loops are limited in their movement relative to each other for resisting and distributing loads placed upon the body support when in use.

15. The body support defined in claim 11 wherein there is further included a plurality of spaced cross wires extending transversely of the body support and being attached to the sides of the border wire, said cross wires being attached to the upper runs of said support members.

16. A body support comprising a plurality of rows of wire-like support members extending across said body support at locations spaced substantially throughout the length of said body support, said support members each having upper and lower runs extending transversely of said body support with the upper runs being connected to each other and the lower runs being connected to each other to form a chain of support members across said body support, an upper frame including a border wire having opposite sides, said support members being connected to said opposite sides of said border wire, said upper frame further including a plurality of wire runners extending longitudinally of said body support at locations spaced transversely of the body support and having opposite ends attached to the border wire, said runners having offset intermediate portions extending transversely of said body support and connected to upper runs of said support members, and wherein said support members are mounted for movement between an erect position wherein they extend generally vertically and a retracted position wherein they extend generally horizontally.

17. A body support such as a mattress or a box spring including a plurality of support members each made of wire-like material and including upper and lower runs, each of said upper and lower runs have a generally vertical extending coil on one end and a hook on the opposite end, said support members being arranged in a plurality of spaced rows with the coils of one run receiving the hooks of an adjacent run such that the support members in each row are linked together in a chain-like fashion, said coils and hooks being dimensioned such that adjoining hooks and coils are limited in their movement relative to each other for resisting and distributing loads placed upon the body support when in use.

18. The body support defined in claim 17 wherein said upper and lower runs of each support member include generally straight wire portions and extend in generally the same plane.

19. The body support defined in claim 17 further including a plurality of runners of spring wire material extending in spaced rows over and across the upper runs of said support members and being attached thereto, said support members also being formed of spring wire material.

20. A body support such as a mattress or a box spring including a plurality of support members each made of wire-like material and including upper and lower runs, each of said upper and lower runs of each support member are generally straight wire portions, extend in generally the same plane, and have a loop on one end and a hook on the opposite end, said support members being arranged in a plurality of spaced rows with the loops of one run receiving the hooks of an adjacent run such that the support members in each row are linked together in a chain-like fashion, said loops and hooks being dimensioned such that adjoining hooks and loops are limited in their movement relative to each other for resisting and distributing loads placed upon the body support when in use, said support members include intermediate runs interconnecting the upper and lower runs and including coiled portions, and wherein said loops each include at least one coiled portion, each of said support members being made from a single piece of wire material.

21. A body support such as a mattress or a box spring comprising upper and lower frames, a plurality of support members mounted between said frames for movement between an erect position wherein said frames are spaced apart for use and a retracted position wherein said frames are brought closer together than when the support members are in said erect position, each of said frames including first and second sections and a transition section interconnecting said first and second sections for movement between a first position wherein said first and second sections are generally coplanar and a second position wherein one section overlies the other section, and wherein said support members are movable between said erect and retracted positions thereof in response to movement of said first and second sections between said first and second positions thereof.

22. The body support defined in claim 21 further including constraining means interconnecting the transition sections of the upper and lower frames to maintain the transition sections in a predetermined position relative to each other.

23. The body support defined in claim 22 wherein said constraining means is yieldable in a vertical direction upon movement of said sections relative to each other between said first and second positions thereof.

24. The body support defined in claim 23 wherein said first and second sections are each pivotally connected to said transition section to be pivotable relative to said transition section between said first and second positions thereof.

25. The body support defined in claim 21 wherein said first and second sections are each pivotally connected to said transition section to be pivotable relative to said transition section between said first and second positions thereof.

26. The body support defined in claim 25 wherein said transition section provides a space between said first and second sections when in said second position.

27. The body support defined in claim 21 wherein said transition section includes means preventing the support members to move to the retracted position as long as said first and second sections are in generally coplanar position.

28. A body support such as a mattress or a box spring including a plurality of support members each made of wire-like material and including upper and lower runs, each of said upper and lower runs have a loop on one end and a hook on the opposite end, said support members being arranged in a plurality of spaced rows with the loops of one run receiving the hooks of an adjacent run such that the support members in each row are linked together in chain-like fashion, said body support further including upper and lower frames, and wherein said support members are pivotally connected to the upper and lower frames for movement between a retracted position wherein said upper and lower frames are spaced a first distance from each other for storage or handling and an erect position wherein said upper and lower frames are spaced from each other a second distance greater than said first distance for use of said body support.

29. A mattress comprising in combination, an upper frame including an upper border wire, a lower frame including a lower border wire, a plurality of support springs located between the upper and lower frames and arranged in a plurality of rows extending along a first direction and with a plurality of springs in each row, said springs each including upper and lower runs, said springs including outwardly positioned springs whose upper and lower runs are connected to the upper and lower border wires respectively, means interconnecting said springs in each row along said first direction, and means interconnecting said springs along a second direction transverse to said first direction including a plurality of runner wires interconnecting the upper runs of springs of adjacent rows, and a plurality of runner wires interconnecting the lower runs of springs of adjacent rows, said runner wires extending in said second direction and including straight wire portions and offset intermediate portions extending at an angle to said straight wire portions and generally along said first direction while being connected to upper and lower runs of the springs respectively such that the runners are deflectable in torsion about axes extending in said first direction and through said offset portions when the mattress is loaded during use, and wherein the upper and lower border wires including the springs and runners provide body support or sleeping surfaces on opposite sides of the mattress.

30. The mattress defined in claim 29 wherein said upper and lower border wires include portions which are pivotally interconnected to allow one portion of the mattress to be pivoted relative to another portion of the mattress.

31. The mattress defined in claim 30 wherein said support springs are retractable to decrease the distance between the upper and lower frames.

32. The mattress defined in claim 29 wherein said runners are made from spring wire.

33. The mattress defined in claim 29 wherein said springs are movable between an erect position wherein they extend generally vertically and a retracted position wherein they extend generally horizontally.

34. A body support such as a mattress or a box spring including an upper border wire, a plurality of support members each made of wire-like material and including upper and lower runs, said upper runs including outwardly positioned runs connected to the upper border wire, each of said upper and lower runs have a generally vertically extending coil on one end and a hook on the opposite end, said support members being arranged in a plurality of spaced rows with the coils of one run receiving the hooks of an adjacent run such that the support members in each row are linked together in chain-like fashion, said coils and hooks being dimensioned such that adjoining hooks and coils are limited in their movement relative to each other for resisting and distributing loads placed upon the body support when in use.

35. The body support defined in claim 34 further including a lower border wire and wherein said lower runs include outwardly positioned runs connected to the lower border wire.

36. The body support defined in claim 34 further including a plurality of runner wires extending transversely of said upper runs while being connected thereto.

37. The body support defined in claim 35 further including a plurality of upper and lower runner wires extending transversely of said upper and lower runs while being connected thereto respectively.

38. A body support such as a mattress or box spring including an upper border wire, a plurality of support members each made of wire-like material and including upper and lower runs, said upper runs including outwardly positioned runs connected to the upper border wire, each of said upper and lower runs have a loop on one end and a hook on the opposite end, said support members being arranged in a plurality of spaced rows with the loops of one run receiving the hooks of an adjacent run such that the support members in each row are linked together in chain-like fashion, said loops and hooks being dimensioned such that adjoining hooks and loops are limited in their movement relative to each other for resisting and distributing loads placed upon the body support when in use, said body support further including a plurality of runner wires extending transversely of said upper runs while being connected thereto, wherein said runner wires have offset portions connected to said upper runs such that the runners are deflectable in torsion about said offset portions when the body support is loaded during use.

39. A mattress comprising in combination upper and lower border wires, a plurality of support springs located between the border wires in rows extending in a first direction, each of said springs including upper and lower runs including bent portions in the opposite ends of each run with the bent portions of adjacent springs in each row being interlocked to form a chain of springs extending in said first direction, said interlocked bent portions being dimensioned such that they are limited in movement relative to each other for resisting and distributing loads placed upon the mattress when in use, and a plurality of runner wires extending in a second direction transverse to said first direction while being connected to upper and lower runs of said support springs, and wherein outwardly positioned support springs in each row have their upper and lower runs connected to the upper and lower border wires respectively, wherein said runner wires have offset portions located intermediate their ends and extending generally in said first direction while being connected to the upper and lower runs respectively of said support springs such that the runner wires are deflectable in torsion about axes extending in said first direction and through said offset portions when the mattress is loaded during use.

* * * * *